US005374939A

United States Patent [19]

Pullen V

[11] Patent Number: 5,374,939

[45] Date of Patent: Dec. 20, 1994

[54] RADIATION GATHERING AND FOCUSING APPARATUS

[76] Inventor: William J. Pullen V, P.O. Box 10202, Santiago, Chile

[21] Appl. No.: 86,830

[22] Filed: Jul. 7, 1993

[51] Int. Cl.[5] ..... H01Q 19/10

[52] U.S. Cl. ..... 343/839; 343/840; 126/573; 126/694; 126/576

[58] Field of Search ..... 126/573–574, 126/576–578, 688–695; 353/3; 343/839, 840

[56] References Cited

U.S. PATENT DOCUMENTS 3,305,686 2/1967 Carter et al. ..... 126/577
4,116,541 9/1978 Weiss .
4,967,730 11/1990 Billheimer ..... 126/694

FOREIGN PATENT DOCUMENTS 1118320 6/1968 United Kingdom .
207380 10/1980 United Kingdom .

*Primary Examiner*—Carroll B. Dority
*Attorney, Agent, or Firm*—Wigman, Cohen, Leitner & Myers

[57] ABSTRACT

An apparatus for gathering and focusing or for transmitting radiation including a reflecting surface formed by portion of a right circular cone, a linear collector/-transmitter located within the cone and connected to a vertex of the cone. An adjustable support can be used to vary the position of the collector/transmitter relative to the reflecting surface in response to a change in direction of the radiation. Adjustable support can also be provided to the reflecting surface so as to adjust its orientation in response to a change in direction of the radiation.

11 Claims, 10 Drawing Sheets

RADIATION GATHERING AND FOCUSING APPARATUS

TECHNICAL FIELD

This invention is directed to radiating apparatus for gathering and focusing or for transmitting radiation. More particularly, the present invention is directed to radiation apparatus including a reflecting surface formed by a portion of a right circular cone. An adjustable support can be included to adjust the reflecting surface orientation vis-a-vis the radiation direction.

BACKGROUND OF THE INVENTION

In the field of solar electricity generation, reflectors are commonly used which are parabolic in one plane only and extend linearly perpendicular to that plane such that they are symmetrical about that plane. With such two dimensionally parabolic reflecting surfaces, all radiation which is parallel to the axis of the parabola and is incident on the reflecting surface is focused at a focus line.

These prior art devices incorporating parabolic mirrors suffer from the disadvantage that the parabolic shape is very difficult to generate and manufacture. Despite being well defined mathematically and geometrically, a mirror with a parabolic shape is complex to create and beyond the capabilities of most workshops. Thus, so-called parabolic mirrors are often only approximations to parabolas, and are significantly less efficient than true parabolas. Allied to this problem is the high cost of complicated testing of the parabolic surfaces.

Furthermore, with the increasing dimensions of modern parabolic mirrors for astronomical applications (parabolic antennae having diameters up to 76.2 m (250 ft) are known), there is also the difficulty of maintaining the parabolic shape of the mirrors against the effect of gravitational forces. The above problems are equally true for circular, elliptical and hyperbolic reflecting surfaces.

One solution to the above problem of maintaining, for example, a parabolic shape against the effects of gravitational distortion is referred to as "active optics". A plurality of movable supports for a parabolic mirror are adjusted under computer control after an image analysis. This active optics adjustment of a mirror is limited to only slight corrections to the optical characteristics and maintenance of the parabolic shape. Active optics provides no solution to the problems of manufacture of a parabolic mirror.

SUMMARY OF THE INVENTION

In a first aspect, the present invention seeks to provide an apparatus which easily and conveniently provides an exact conic section reflecting surface for either collecting and focusing or transmitting radiation, which apparatus does not necessitate complex testing for compliance with the selected conic section shape.

In a second aspect, the present invention seeks to provide an apparatus for gathering and focusing and/or transmitting radiation, which can accept modification to its shape to change its reflecting characteristics.

In a third aspect, the present invention seeks to provide an apparatus for gathering and focusing and/or transmitting radiation, which has a collecting/transmitting member which is positionally adjustable relative to the reflecting member of the apparatus, so as to maintain the high efficiency of the apparatus as the incident angle of the radiation changes during the operation of the apparatus.

In a fourth aspect, the present invention seeks to provide an apparatus for gathering and focusing radiation, the apparatus further comprises an adjustable support for the reflecting surface so that the orientation of the reflecting surface can be adjusted as the incident angle of the radiation changes during the operation of the apparatus.

The present invention provides an apparatus for gathering and focusing and/or for transmitting radiation, which apparatus includes a portion of a right circular cone providing a reflecting surface and an elongate collector or transmitter within said cone with its axis of elongation at a non-zero angle to the axis of symmetry of said cone and passing through the vertex of the cone. The reflecting surface may be provided by a portion of a cone which is symmetrical about the cone axis and includes the vertex of the cone. Alternatively, the reflecting surface may be a part only of such a cone surface.

In use in a radiation gathering mode, the reflecting surface is oriented relative to the incoming radiation such that all radiation incident on the reflecting surface from a certain direction is focused at a focus line. The collector is positioned along this focus line. In a transmitter mode, the reflecting surface is so oriented that radiation from the transmitter which is incident on the reflecting surface, is reflected in a desired direction.

It is preferred that the reflecting surface is asymmetrical about the axis of symmetry of the right circular cone. It is also preferred that the portion of the right circular cone which provides the reflecting surface does not include the vertex of the cone. It is also preferred that the portion of the cone does not include part of the cone lying between two separate generatrix line. That is to say that the reflecting surface has an open channel structure which does not include any enclosed part surrounding the axis of the cone.

The reflecting surface may be symmetrical about a plane which includes the axis of elongation of the collector or transmitter and the axis of symmetry of the cone. The reflecting surface may have edges perpendicular to the aforesaid plane of symmetry which edges are conic.

It is preferred that the apparatus includes means for adjusting the orientation of the reflecting surface relative to the direction of incoming radiation or relative to a desired transmission direction. Thus, incoming radiation is focusable at a desired focus line and radiation from the transmitter which is incident on the reflecting surface may be reflected in a desired direction. An explanation of the above is as follows.

A conic section is generated by the intersection of a plane with the surface of a right circular cone. For example, if the plane is parallel to a generatrix line of the cone (i.e. a straight line along the surface of the cone and passing through the vertex thereof), then the conic line of intersection is a parabola.

The reflecting surface thus has similar reflecting properties to a parabolic reflecting surface, focusing incoming radiation which is parallel to an element of the cone to a focus line. The reflecting surface of the right circular cone can be visualized as an infinite array of parabolic surface lines, which parabolic surface lines each focus radiation which is parallel to their axis to a particular focus point. The parallel radiation is thereby focused to a focus line which joins all of the focus points and which passes through the vertex of the right circular cone.

In a preferred embodiment, there are means for adjusting the orientation of the reflecting surface so that the collector may be at a desired focus line for different orientations of the reflecting surface adjusted according to the direction of incoming or outgoing radiation. Different conic sections will be generated for different relative orientations, and their focus lines will correspondingly be at different angles to the cone axis.

In another preferred embodiment, there are means for selectively adjusting the position of the collector in relation to the reflecting surface in response to the change of the incident angle of the incoming radiation, so as to keep the apparatus at a high operating efficiency without changing the orientation of the reflecting surface. Preferably such adjustment of the collector is made automatically according to the periodical change of the incoming radiation or according to the detected direction of the incoming radiation.

The apparatus may include means for changing the shape of the right circular cone so as to change the reflecting characteristics of the reflecting surface.

The construction of a circular cone, or a portion of one, is far simpler than constructing a paraboloid, ellipsoid or hyperboloid. A right circular cone or a portion of one may be formed by curving a flat sheet around two or more circles of different diameters for the required degree of curvature. The generation of a true paraboloid, ellipsoid or hyperboloid involves for example a generation of a conic section, the revolution of that conic section around its axis, and the deformation of a material surface to conform to the parabolic, elliptical or hyperbolic surface. Once formed, such a surface can only be reshaped or modified by time consuming and inconvenient material shaping methods (such as abrasion, erosion, polishing, grinding, stamping).

Most parabolic devices are either of rigid structure with fixed parameters which cannot be changed after construction or have parameters which can only be adjusted slightly (such as by active optics). A device formed of a portion of a right circular cone according to the present invention may be formed of segments, which can be folded and then unfolded, which may be of great use in applications such as satellite receivers where a transmitter or collector may be erected after the satellite is in orbit.

A device manufactured as a portion of a circular cone may be easily shaped, reshaped, rolled or folded, changing its parameters. A receiver or transmitter with a parabolic reflecting effect may be changed in this way into one with an elliptical reflecting effect, for example.

There is a further advantage for using a portion of an inner conic surface as a reflecting surface for focusing radiation. Namely, if such a reflecting surface is kept at a fixed orientation, the change of the incident angle of the radiation will change the position of the focus line relative to the reflecting surface. However, the focus line will still be a line extending through the vertex of the cone. That means the collector of the present invention can be made in the shape of an elongated member which can be easily adjusted to the position of the focus line for high efficient collecting of the radiation.

Such freedom for changing the parameters of a receiver or transmitter may permit a single device to perform activities which currently require two or more devices. In the case of a satellite, for example, a single apparatus might serve as the reflecting surface of a collector and as shielding at different stages during the flight of the satellite.

With the foregoing and other objects, advantages, and features of the invention which will become hereinafter apparent, the nature of the invention may be more clearly understood by reference to the following detailed description of the invention, the appended claims, and to the several views illustrated in the attached drawings.

BRIEF DESCRIPTION OF THE DRAWING FIGURES

The present invention will now be illustrated and explained by embodiments which are described hereinbelow with reference to the accompanying drawings in which:

FIGS. 1*a* and 1*b* show a radiation gathering and focusing apparatus embodying the present invention, which uses reflecting conic sections;

FIGS. 2*a* and 2*b* show a radiation gathering and focusing device which is a second embodiment of the present invention;

FIG. 3*a* is a front view and FIG. 3*b* is a side view of a focusable radiation gathering and focusing apparatus which is a third embodiment of the present invention;

Figure 7C:
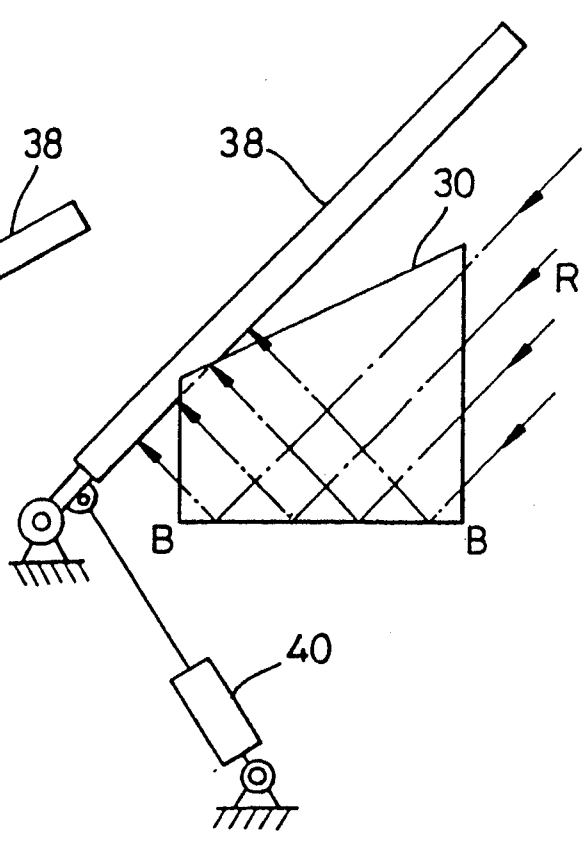
Figure 7B:
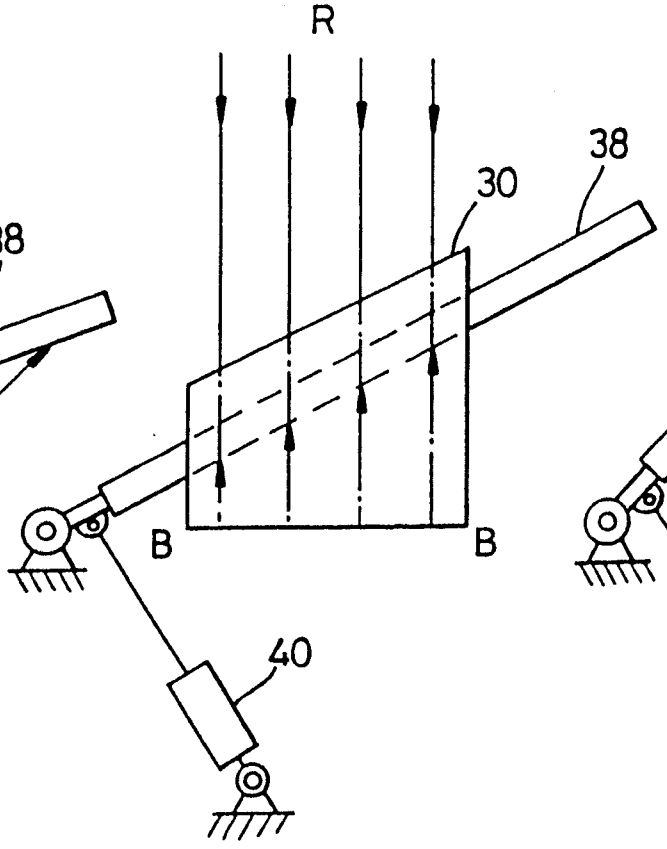
Figure 7A:
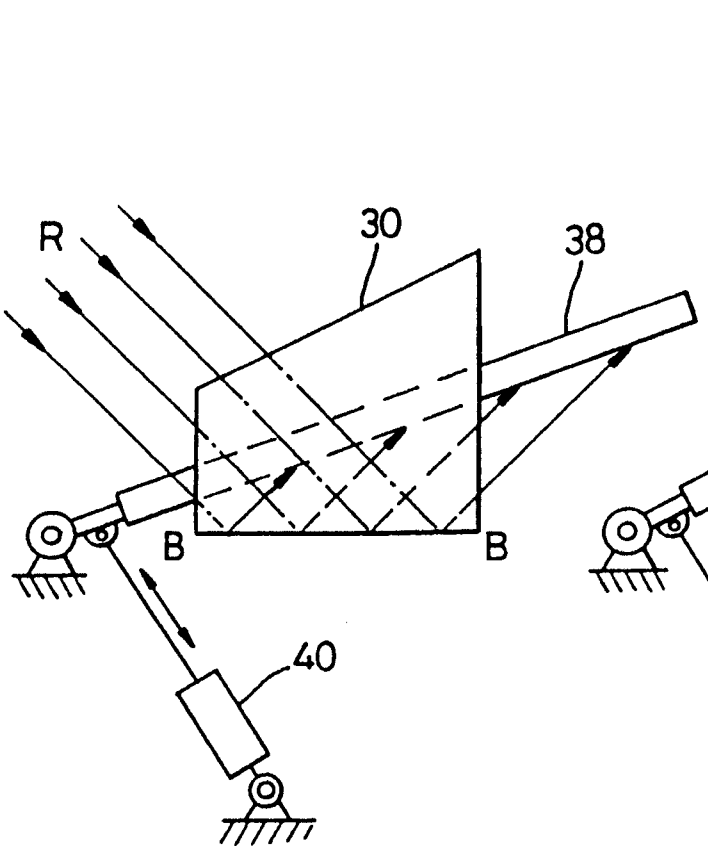

FIGS. 7*a* to 7*c* show a radiation gathering and focusing apparatus which is a sixth embodiment of the present invention.

Figure 8:
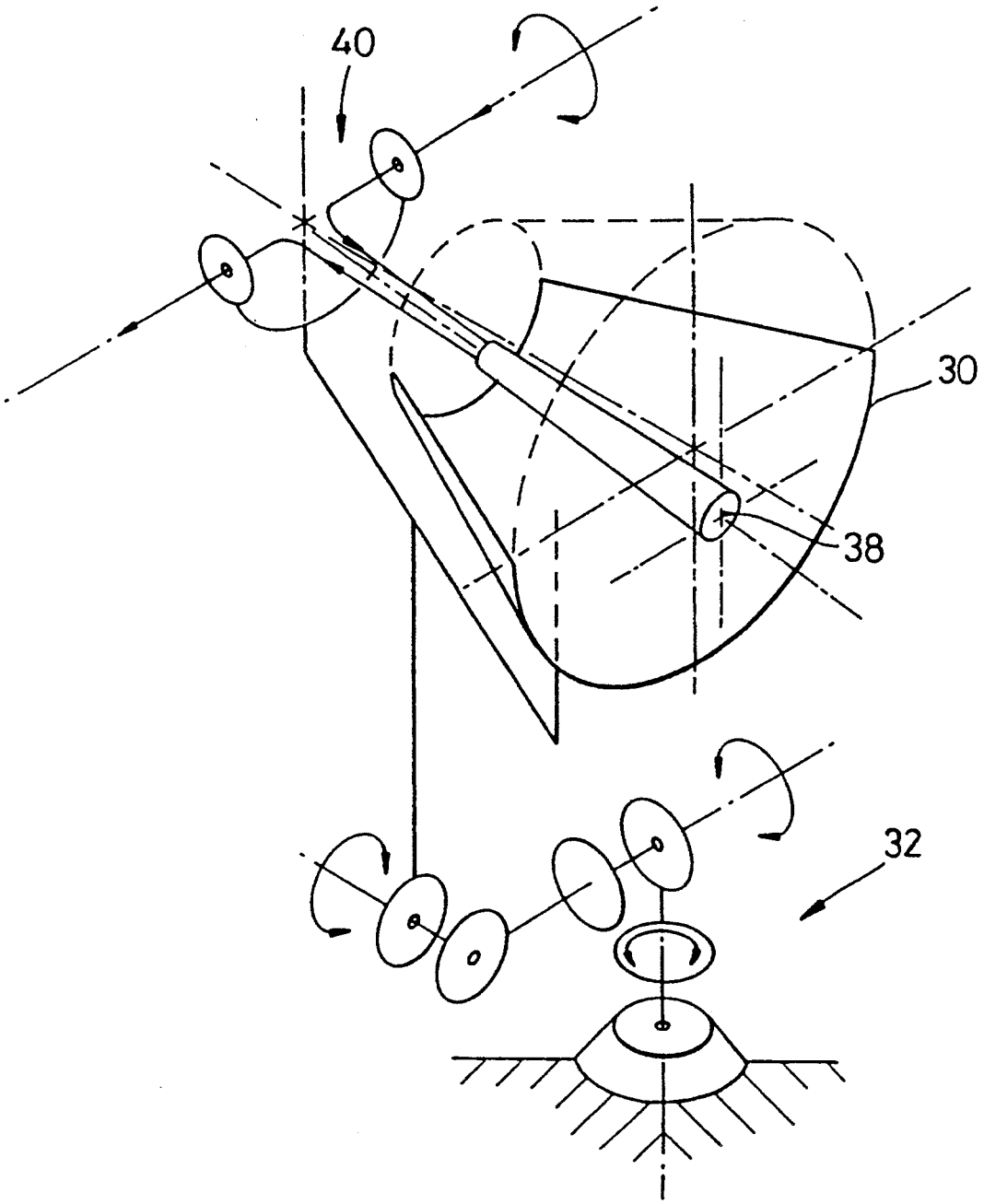

FIG. 8 shows radiation gathering and focusing apparatus which is a seventh embodiment of the present invention.

Figure 9A:
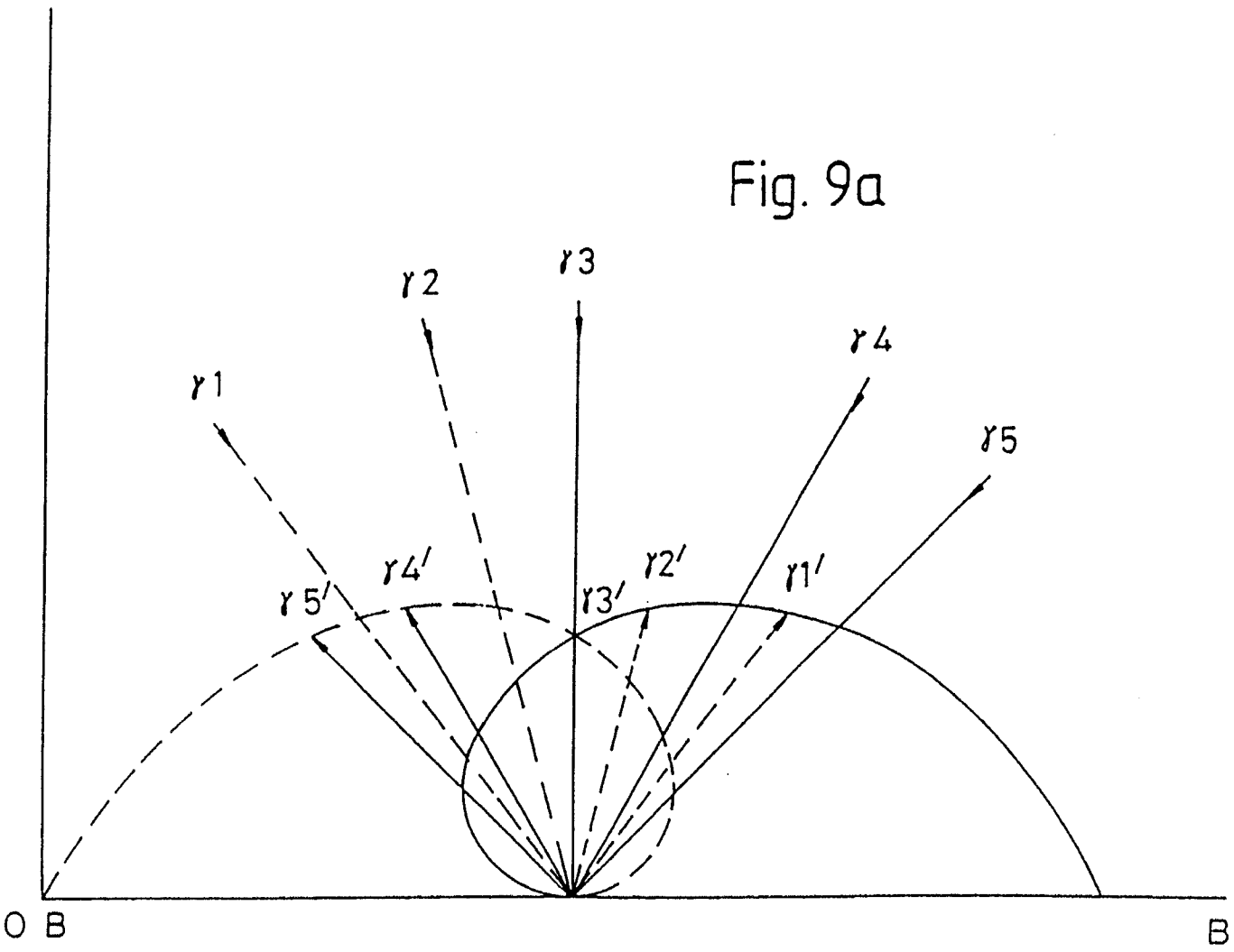
Figure 9B:
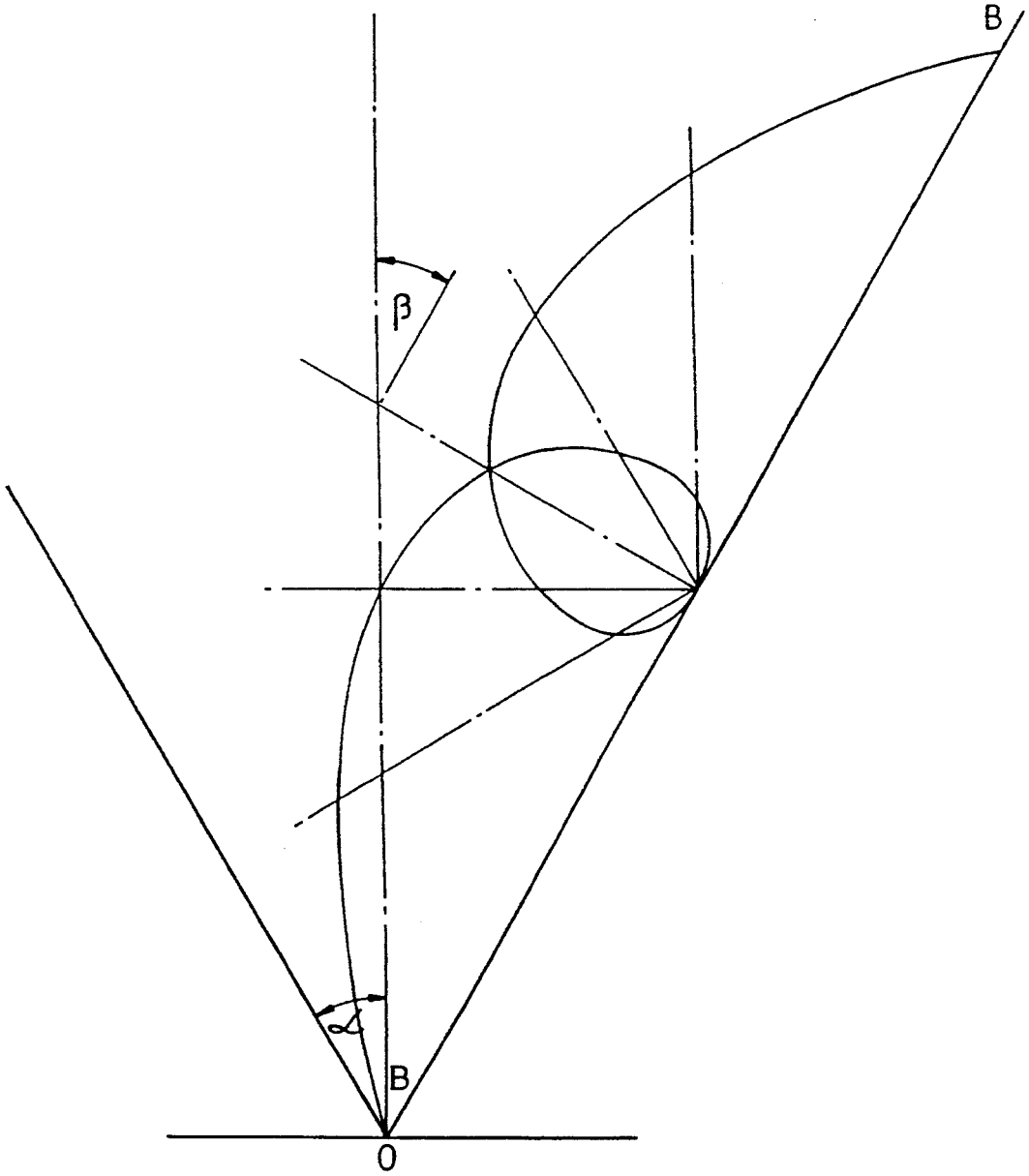
Figure 9C:
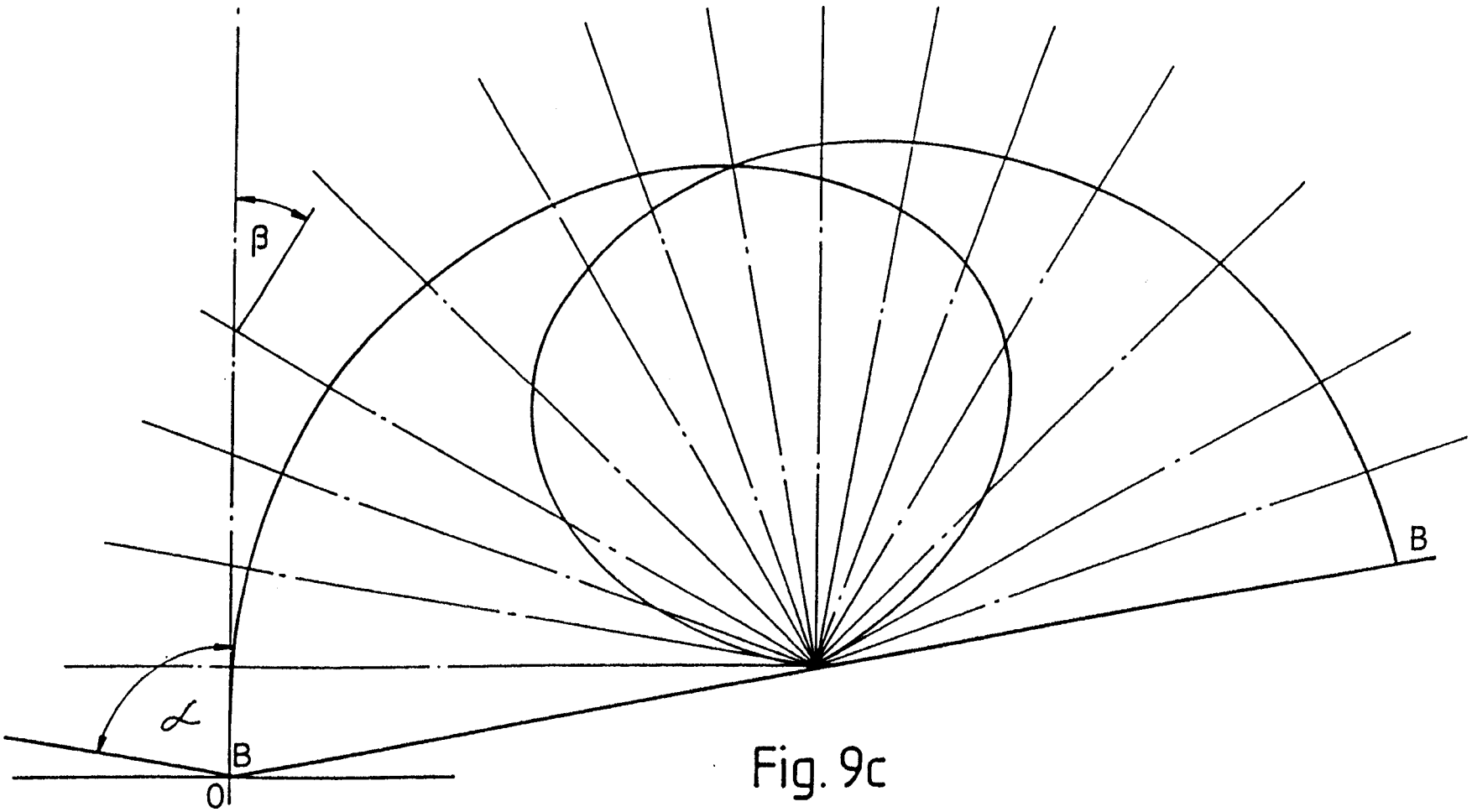

FIGS. 9*a* to 9*c* shows the change of the focus line in the device shown in FIGS. 7*a* to 7*c* and FIG. 8.

DETAILED DESCRIPTION OF THE INVENTION

Figure 1A:
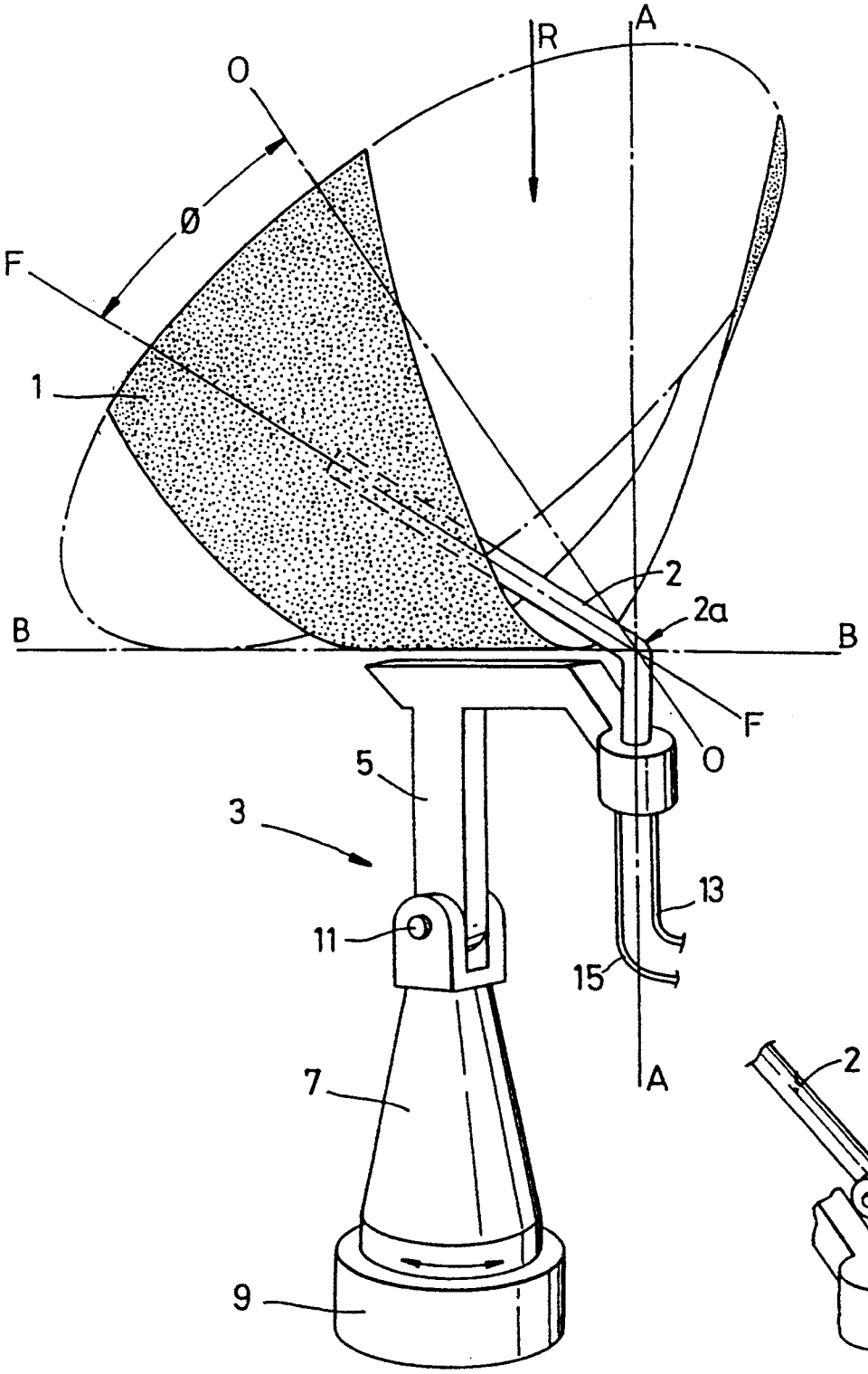

A solar radiation gathering and focusing apparatus embodying the present invention is shown in FIG. 1*a*. A reflecting surface 1 is a portion of a right circular cone. (The cone is shown in broken lines with its axis represented by the line O—O, and two generatrix lines along its surface represented by the lines A—A and B—B). The reflecting surface 1 is asymmetric about the axis of symmetry of the right circular cone. The vertex of the cone is not within the reflecting surface. A linear collector 2 is aligned with the vertex of the right circular cone (along the line F—F in FIG. 1*a*). The line F—F is at a non-zero angle to the line O—O, this angle preferably being between 5° and 45°. The reflecting surface is symmetric about a plane which includes the lines O—O and F—F. The reflecting surface has edges perpendicular to this plane which are parabolic. The reflecting surface 1 and collector 2 are both attached to a support 3. The support 3 is formed in three portions; an upper portion 5, a mid portion 7 and a fixed lower portion 9. The collector 2 and reflecting surface 1 are attached to the upper portion 5, which is pivotally attached to the mid portion 7 about the pin 11. The mid portion 7 is rotatable in relation to the lower portion 9. Thus the cone can be oriented over a wide range of directions.

Figure 1B:
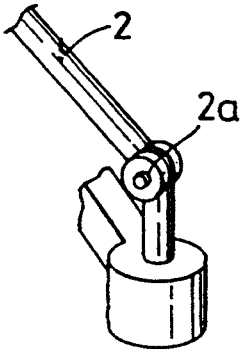

As shown by FIG. 1*b*, the linear collector 2 can be connected to the upper portion 5 by a pivot connection 2*a*. This arrangement may provide further flexibility to the arrangement so that the direction of the linear collector 2 can be easily adjusted to keep it in the focus line of the reflecting surface 1.

The collector 2 is a transparent vacuum tube collector of known type. A heat absorbing medium passes into the tube through in-flow pipe 13, is heated by radiation focused by the reflecting surface 1 and passes out through the out-flow line 15. The in-flow, out-flow and adjoining lines are disposed in a vacuum which restricts convection and conduction heat losses from the collector. In use the reflecting surface is oriented towards the sun in response to a detector (not shown) so a straight line passing along a surface of the right circular cone and through the vertex of the cone (hereinafter a "generatrix line") is parallel to the incoming radiation (that surface line being along the line A—A in FIG. 1*a*. The direction of the incoming radiation is shown by the arrow labelled R in FIG. 1*a*). In this position the right circular cone behaves in relation to this incoming radiation in a similar manner as a two-dimensionally parabolic mirror, That is to say, all points on the inner surface of the portion of the right circular cone receiving the radiation reflect the radiation to a focus line (the line F—F in FIG. 1*a*), for the following reason.

A parabola is generated by the intersection of a plane with the surface of a right circular cone, if the plane is parallel to one generatrix line of the cone. An infinity of mutually parallel planes which are parallel to a generatrix line of a right circular cone and intersect the cone will generate an infinity of parabolas with their focus points Joined by a focus line passing through the vertex of the right circular cone.

The linear collector 2 is positioned along this focus line F—F of the reflecting surface 1 and all radiation parallel to the line A—A and incident on the reflecting surface 1 is focused at the collector.

A right circular cone with a half angle ($_2\Theta$) of 45° and with one of its generatrix lines aimed precisely at the sun's centre, will reflect and focus the sun's rays to a focus line with an angle $\alpha$ relative to the cone's axis of 18.4°.

The invention is equally embodied by a radiation transmitting apparatus which is analogous to the collecting apparatus of FIG. 1*a* but in which the collector is replaced by a linear source and the reflecting surface is effective to produce a beam of radiation in a desired direction.

Figure 2A:
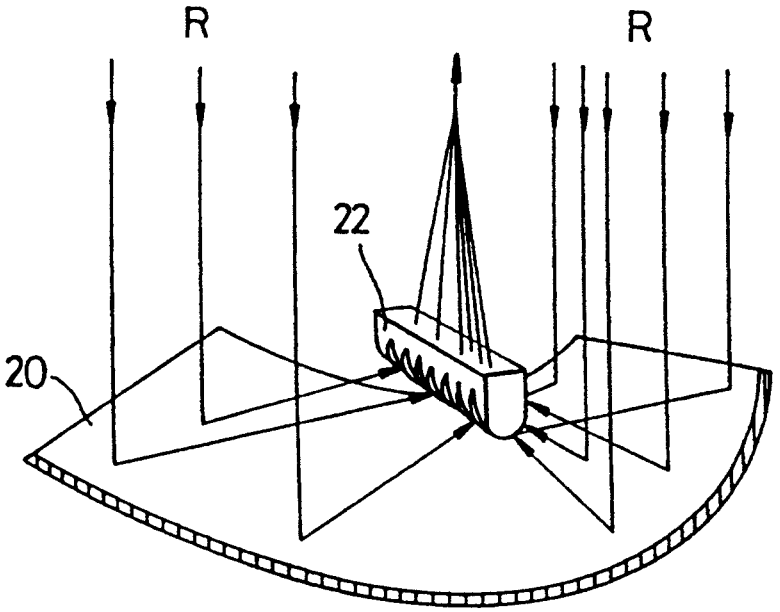
Figure 2B:
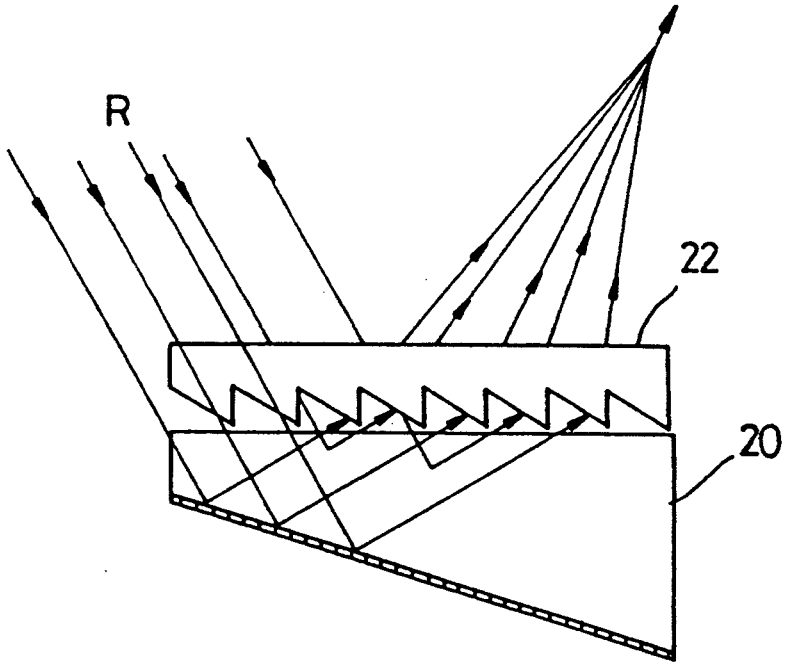

A reflecting surface 20 according to the present invention is shown in association with a Fresnel type lens 22 in FIGS. 2*a* and 2*b*. With such a system, positioning the Fresnel type lens 22 at the focus line of the reflecting surface, allows received radiation to be focused to a point instead of a focus line. The surface of the lens nearest the reflecting surface is curved such that light which is incident on the lens is refracted away from the reflecting surface to provide a focus point on the far side of the lens from the reflecting surface. Focusing of received radiation to a point may also be achieved by replacing the elongate collector with a parabolic or approximately parabolic reflecting surface which opposes the conical reflecting surface. For ease of manufacture, such an approximately parabolic surface is preferably a stepped surface.

Figure 3A:
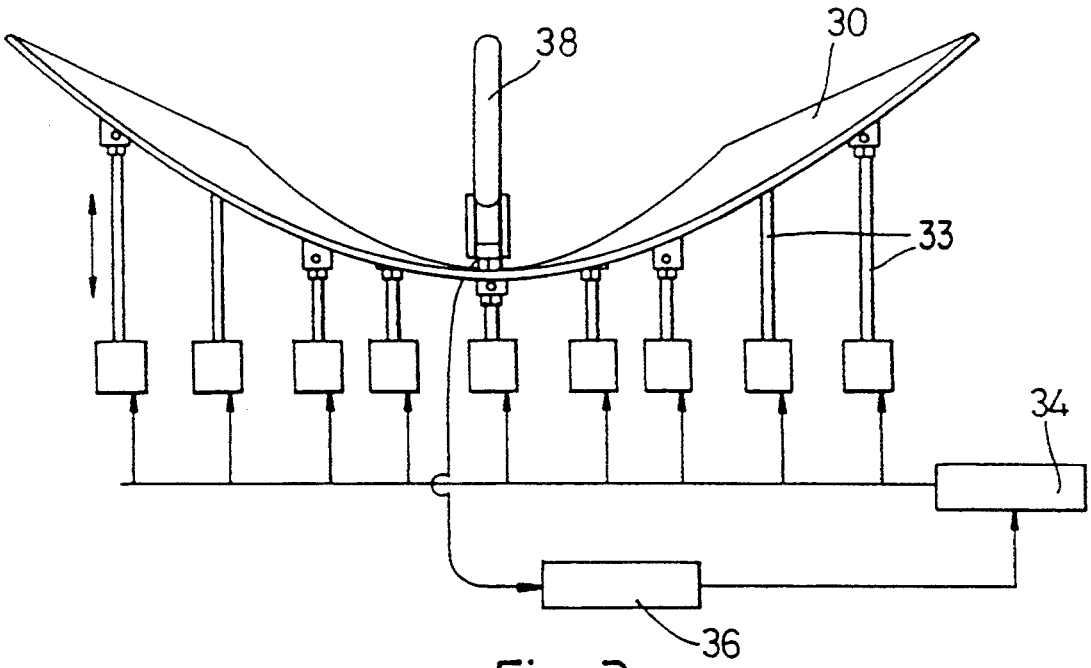
Figure 3B:
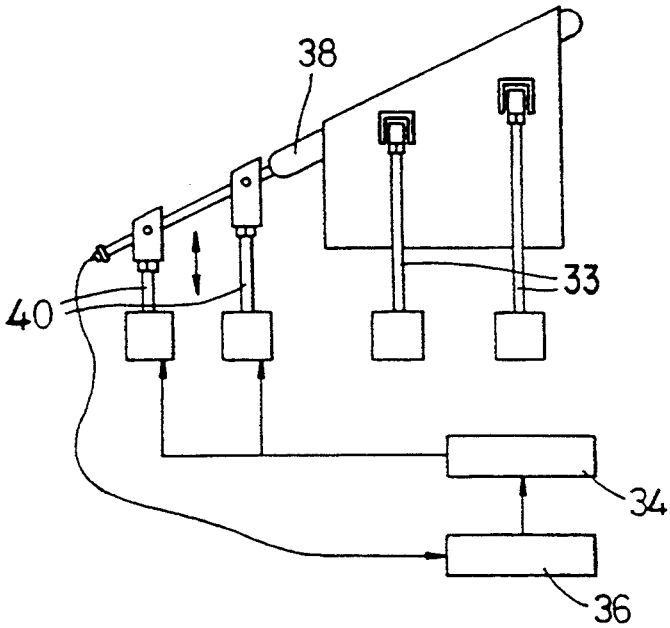

A third embodiment of the present invention shown in FIG. 3 is a continuously adjustable radiation gathering and focusing apparatus, including a distance sensor 36, and a receiver 30,38 tunable to a source at best efficiency, regardless of distance variations.

A reflecting surface 30 is supported by a plurality of movable supports 33, which are adjustable under the control of a computer 34 in response to information received from the distance detector 36 which performs image analysis. A collector 38 is also movable by movable supports 40.

The shape of the reflecting surface 30 is adjusted by the supports 32 to provide the desired reflecting surface. The supports 40 move the collector 38 to a desired location at which it forms a focus line of the surface of the receiver 30. The location of the collector 38 may be such that the device operates in an ellipse mode, with the source at the other focus or in a parabola mode with the source effectively at infinity.

The collector 38 is thus movable relative to the reflecting surface 30 so as to be alignable along the respective focus line for the full range of possible configurations of the reflecting surface. When the cone surface provides a surface having parabolic effect (parabolic mode), the focus line is at an angle of 18.4° to the axis of the cone for a cone with an apex half-angle of 45°. The orientation of the focus line for an ellipse mode reflecting surface is between that for a parabolic mode and that for a circular mode (in which the focus line is at the axis of the cone). The focus line for a hyperbola mode reflecting surface is between the angles of 18.4° and 45° to the cone's axis for a cone with an apex half-angle of 45°. The required degree of movement of the collector is determined by the range of reflecting surface characteristics required of the apparatus in a given application.

Of course, the invention is applicable to a radiation transmitter wherein the collector is replaced by a source, and the reflecting surface radiates a beam, e.g. focuses light from the source on a target. A device may be provided which embodies the present invention, which incorporates an element which functions alternately as a source and as a collector.

A search-tracking microwave transmitter and receiver based on this principle would represent a great improvement over the prior art because it is focusable on a target so as to give improved clarity over the prior art after the target is detected using a different broad range detector such as is known.

The facility for adjustment of a reflecting surface and thereby changing its reflecting characteristics is extremely useful for automobile headlamps. In the present systems, the change of range of the light beam is achieved by switching headlamp units or switching light bulb filaments. The known units are therefore of complicated design. A headlamp according to the present invention using a portion of a right circular cone as the reflecting surface can easily vary a light beam to achieve the required shape and range, by tilting the light source located at the focus line or by tilting or changing the shape of the reflectors' body. This will accomplish a smooth change from close-focused to a parallel or wide angle beam.

For example, for a cone with an apex half-angle of 45°, if the reflector's body is oriented relative to the light source such that the angle between the cone axis and the axis of elongation of the source is 18.4°, then there will be a region of maximum transmitted light intensity which is focused at infinity. If the angle of relative orientation is reduced, then the light will be focused closer, reducing the size of the region of maximum transmitted light intensity. Conversely, if the angle of relative orientation is increased, then light will diverge from the reflecting surface giving a larger region of maximum transmitted light intensity.

Increasing the diameter of the portion of a cone of which the reflecting surface forms a part also widens the region of maximum transmitted light intensity.

The present invention is also applicable to search lights and may be utilized in camera flash units.

Figure 4:
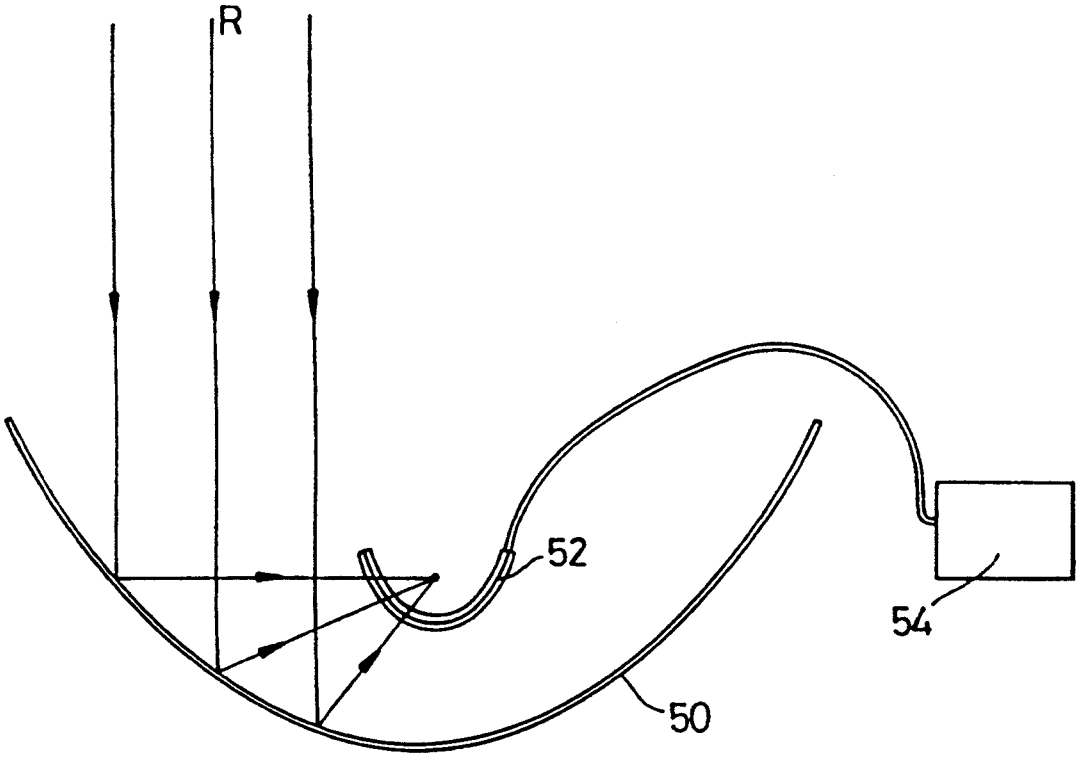
FIG. 4 shows an electronic wide-slit telescope constituting a fourth embodiment of the present invention.

An electronic wide-slit telescope incorporating a portion of a right circular cone as a receiver unit is shown in FIG. 4. An optical quality surface-coated right circular cone reflecting surface 50 is provided in association with a charge-coupled device image sensor 52 extending parallel to the focus line (into the plane of the paper in FIG. 4) and consisting of a plurality of light-sensitive silicon chips (preferably thousands of minute chips) electronically coupled to a receiver unit 54 which provides image reconstruction according to known techniques. A computer-aided reconstruction technique facilitates reconstruction of a wide field image at a television screen (not shown).

When light is focused on the surface of the device, charges are introduced at the image points by the light-sensitive chips. Image points are accessed sequentially to produce an output signal on a television screen.

Figure 5:
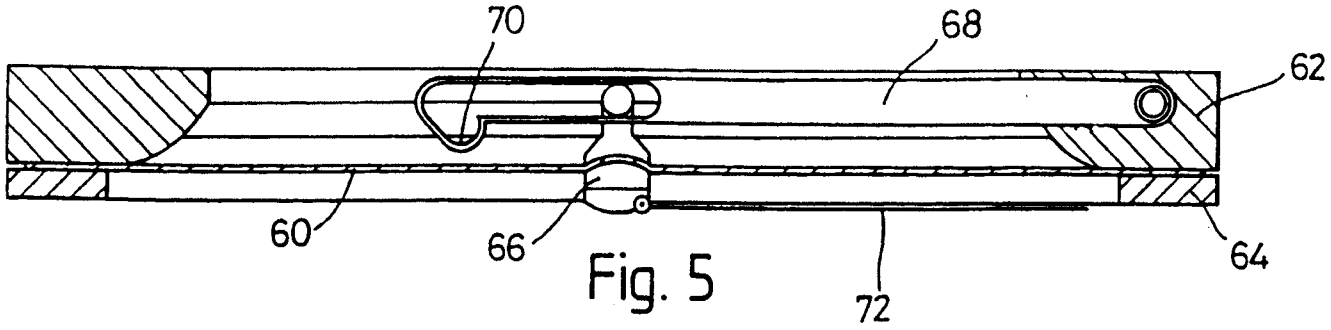
FIG. 5 shows an apparatus for producing an adjustable radiation gathering and focusing device which device is a fifth embodiment of the present invention.
Figure 6:
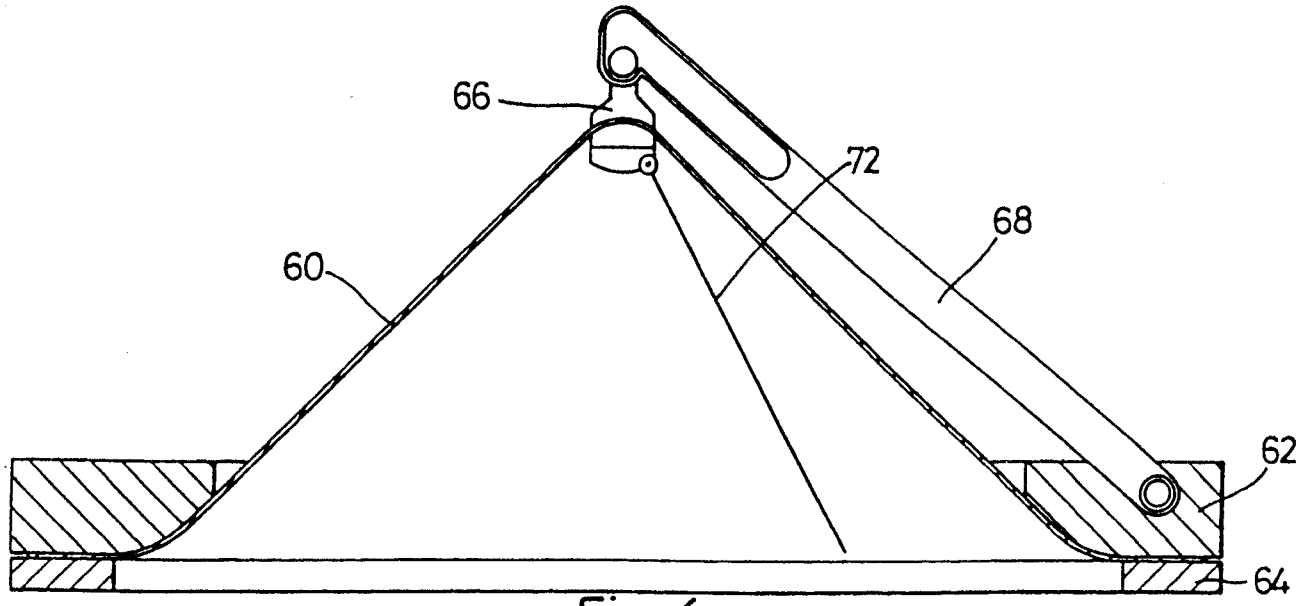
FIG. 6 shows the radiation gathering and focusing apparatus of FIG. 5 in a second condition.

An apparatus for providing a receiver or transmitter incorporating a right circular cone according to the present invention is shown in two different conditions in FIGS. 5 and 6.

An elastic thin film substrate 60, which may be of 'Mylar' (registered trade mark) or other material, is given a metallized coating. The substrate is then clamped between annular supports 62,64 and at its centre by a clamping member 66. The supports 62, 64 and the clamping member 66 are so shaped that there are no significantly high stress points on the substrate 60 in any conditions of the apparatus. The clamping member 66 is movable by an actuator arm 68 in pivotal connection with the support 62. The end of the pivotal arm 68 which is distal from the support 62 has a recess 70 into which a portion of the clamping member 66 is movable. When the portion of the clamping member is positioned in the recess 70, the apparatus is held in a stable condition by the tension in the substrate 60.

A collector 72 is pivotally attached to the clamping member 66 so as to be movable into the position of the desired focus line of the reflecting surface of the substrate 60. The collector 72 is preferably automatically positioned in response to the half-angle of the right circular cone and the orientation of the cone relative to incoming radiation.

The device may be movable between two conditions wherein the substrate 60 forms an approximately flat surface in a first condition and forms in a second condition a portion of a right circular cone. The collector 72 is movable between a first position parallel to the said flat surface and a second position at the focus of the right circular cone. Alternatively, the device may be continuously adjustable between said first condition and a second condition as a right circular cone of adjustable half angle. In the latter case, the collector 72 should be continuously (and preferably automatically) movable in order to be positionable at the focus.

The collector 72 may be replaced by a source to create an apparatus for transmitting radiation. Alternatively an element may function alternately as a source and as a collector.

FIGS. *7a* to *7c* show the arrangement of a sixth embodiment of the present invention. In this embodiment, a generatrix line B—B, which is in the middle of the conic section 30, is arranged horizontal and parallel to the sun's path (Ecliptic). In this embodiment, the position and orientation of the conic reflecting section 30 is kept unchanged during the operation of the device. As the sun moves during the day, the incident angle of the sun ray R changes from that shown in FIG. *7a* which indicates the incident ray of early morning to that of FIG. *7b* for noon time and then to that of FIG. *7c* for late afternoon. As this incident angle of the radiation changes, the focus line of the conic section 30 also changes. The position of the collector 38 is adjusted accordingly by the adjusting member 40, which can be a very simple mechanical or electronic system. The adjustment of the collector 38 can be easily controlled automatically either according to the time of the day or according to a detection of the incident angle of the incoming radiation, as discussed above. In this arrangement, since the position of the collector 38 is adjustable following the change of the incoming radiation, there is no need for frequent adjustment of the conic section 30. Therefore, the supporting structures and shape adjustment of the conic section 30 is very much simplified and the operational and maintaining cost can be significantly reduced. On the other hand, because of the very simple structure of the conic section 30, it can be made in relatively large dimensions to provide increased reflecting surface.

FIG. 8 shows the arrangement of a seventh embodiment of the present invention. In this embodiment the conic reflecting section 30 is supported by a 3-axis adjustable support 32 which is controlled by a control system (not shown), so that the orientation of the reflecting surface 30 can be adjusted to any desirable direction. A linear collector/transmitter 38 is supported by an adjustable pivot support 40 which keeps the collector 38 extending from the vertex of the cone of the surface 30. The pivot support 40 provides further adjustability to the relative position between the collector/transmitter 38 and the reflecting surface 30. It is understood that the embodiment shown in FIG. 8 can be equally used for radiation gathering and focusing or radiation transmitting. The pivot support 40 can be part of the same adjustable support system as that of the support 32 so as to be controlled jointly or separately by the same control system.

FIGS. *9a* to *9c* show the relationship between the incident angle of the incoming radiation and the position of the focus line of the conic reflecting surface. In FIG. *9a*, line B—B represents the generatrix line B—B of, for example, the conic reflecting surface 30 shown in FIGS. *7a* to *7c*. As the direction of the incoming radiation changes from r1 to r5, i.e. as the sun moves during the day, the position of the focus line also changes from the line connecting the focus point r1′ to the vertex point 0 to the line connecting r5′ to the point 0. By adjusting the angular position of the collector 38 shown in FIGS. *3a*, *7a* to *7c* or 8, according to the change of positions of the focus line, the apparatus can operate at a high efficiency without any complicated adjustment of the orientations of the reflecting surface.

It is noted that the conic reflecting section of the present invention can be formed from a circular cone of any apex half-angle less than 90°. In FIG. *9a*, the cone has an apex half-angle $\alpha$ of 45°, while in FIG. *9b*, $\alpha$ is 30° and in FIG. *9c* $\alpha$ is 80°. Once the cone shape (vertex angle) is determined, the angles and distances that define the focus point of any particular conic section can be calculated according to the incident/transmitting angles of radiation. In this way, a curve representing the change of the focus point in relation to the change of incident angle of radiation can be worked out. As shown in FIGS. 9*a* to 9*c*, this curve is in a form resembling an involute of the circle. When this curve is determined, an angular range of the adjustment of a collector relative to the reflecting surface can be determined accordingly. Such adjustment is especially useful if the change of incident angle of the radiation has a known manner, such as the movement of the sun during the day or the movement of a satellite relative to a ground position. It should be understood that similar curves as those shown in FIGS. 9*a* and 9*c* can be calculated for any value of the apex half-angle $\alpha$ of a cone, and the adjustment based on such a curve can be applied to the collector as shown in any of the embodiments according to the present invention.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

I claim:

1. Radiation gathering and focusing apparatus, comprising:

at least a portion of a right circular cone having a vertex and an axis of symmetry, and providing a reflecting surface, wherein the cone portion includes the vertex, an elongated radiation element disposed within the cone-portion and having a longitudinal axis which is positioned at a non-zero angle relative to the axis of symmetry of the cone portion wherein the radiation element passes through the vertex of the cone portion; and means for adjusting the angular relation of the axis of the elongated radiation element and the cone portion.

2. The apparatus of claim 1, further including means for adjusting the orientation of the reflecting surface relative to a desired reception direction of incoming radiation so as to focus the incoming radiation from the desired direction to a desired focus line.

3. The apparatus of claim 2, wherein the reflective surface is oriented relative to the incoming radiation such that substantially all radiation incident on the reflecting surface from a given direction is focused at the focus line.

4. Radiation focusing and transmitting apparatus, comprising:

at least a portion of a right circular cone having a vertex and an axis of symmetry providing a reflecting surface, wherein the cone portion includes the vertex, and an elongated radiation element disposed within the cone portion and having a longitudinal axis which is movably positioned at a non-zero angle relative to the axis of symmetry of the cone portion, wherein the radiation element axis passes through the vertex of the cone portion; and means for adjusting the angular relation of the axis of the elongated radiation element and the cone portion.

5. The apparatus of claim 4, further including means for adjusting the orientation of the reflecting surface relative to a desired transmission direction of outgoing radiation so as to focus the outgoing radiation in a desired direction.

6. The apparatus of claim 5, wherein the reflective surface is oriented relative to the incoming radiation such that all radiation incident on the reflecting surface from a given direction is focused at the focus line.

7. A method of transmitting radiation in a desired direction with at least a portion of a right circular cone having an axis and which provides a reflecting surface, comprising the steps of:

orienting the cone axis at a non-zero angle relative to an axis of elongation of an elongate radiation source disposed within the cone portion;

transmitting radiation from the source with a maximum transmitted intensity in a desired direction; and adjusting the relative angle between the axis of the cone portion and the axis of the radiation element.

8. The method of claim 7 wherein said reflected radiation is transmitted in a direction which is varied by changing said relative angle of orientation.

9. The method of claim 7 wherein a direction of maximum signal propagation is determined by the cone axis orientation relative the radiation source axis.

10. The method of claim 7, further including the step of adjusting the orientation of the reflective surface relative to a desired transmission direction of outgoing radiation so as to focus outgoing the radiation in the desired direction.

11. The method of claim 7, wherein said cone portion has an apex half-angle of about 45° degrees and said angle of relative orientation is about 18.4 degrees, and further including the step of transmitting the maximum radiation intensity parallel to a surface element of the cone.

* * * * *